US007725324B2

(12) United States Patent
Bruhn et al.

(10) Patent No.: US 7,725,324 B2
(45) Date of Patent: May 25, 2010

(54) CONSTRAINED FILTER ENCODING OF POLYPHONIC SIGNALS

(75) Inventors: Stefan Bruhn, Sollentuna (SE); Ingemar Johansson, Luleå (SE); Anisse Taleb, Kista (SE); Patrik Sandgren, Sundbyberg (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 1310 days.

(21) Appl. No.: 11/011,764

(22) Filed: Dec. 15, 2004

(65) Prior Publication Data

US 2005/0160126 A1 Jul. 21, 2005

Related U.S. Application Data

(60) Provisional application No. 60/530,650, filed on Dec. 19, 2003.

(30) Foreign Application Priority Data

Feb. 20, 2004 (SE) ..... 0400415

(51) Int. Cl.

| | |
|---|---|
| ***G10L 19/00*** | (2006.01) |
| ***G10L 21/04*** | (2006.01) |
| ***G10L 19/02*** | (2006.01) |
| ***H04R 5/00*** | (2006.01) |

(52) U.S. Cl. ..... 704/500; 704/229; 704/230; 704/501; 704/503; 704/504; 381/17

(58) Field of Classification Search ..... 704/201, 704/229, 500; 381/1, 23

See application file for complete search history.

(56) References Cited

U.S. PATENT DOCUMENTS 5,285,498 A 2/1994 Johnston (Continued)

FOREIGN PATENT DOCUMENTS

EP 0497413 8/1992

(Continued)

OTHER PUBLICATIONS

Oomen, Werner; Schuijers, Erik; den Brinker, Bert; Breebaart, Jeroen. Advances in Parametric Coding for High-Quality Audio. Philips Digital Systems Laboratories, Eindhoven, The Netherlands ; Philips Research Laboratories, Eindhoven, The Netherlands, AES Convention:114 (Mar. 2003).*

(Continued)

*Primary Examiner*—Talivaldis I Smits
*Assistant Examiner*—Matthew H Baker
(74) *Attorney, Agent, or Firm*—Nixon & Vanderhye P.C.

(57) ABSTRACT

Signals of different channels are combined into one mono signal. A set of adaptive filters, preferably one for each channel, is derived in a respective filter adaptation unit. When an adaptive filter is applied to the mono signal it reconstructs the signal of the respective channel under a perceptual constraint. The perceptual constraint is a gain and/or shape constraint. The gain constraint allows the preservation of the relative energy between the channels while the shape constraint allows more stability by avoiding unnecessary filtering of spectral nulls. The transmitted parameters are the mono signal, in encoded form, and the parameters of the adaptive filters, preferably also encoded. The receiver reconstructs the signal of the different channels by applying the adaptive filters and possibly some additional post-processing.

19 Claims, 7 Drawing Sheets

U.S. PATENT DOCUMENTS

| | | | | |
|---|---|---|---|---|
| 5,434,948 | A * | 7/1995 | Holt et al. | 704/220 |
| 5,694,332 | A | 12/1997 | Maturi | |
| 5,812,971 | A * | 9/1998 | Herre | 704/230 |
| 5,956,674 | A * | 9/1999 | Smyth et al. | 704/200.1 |
| 6,341,165 | B1 * | 1/2002 | Gbur et al. | 381/23 |
| 6,446,037 | B1 * | 9/2002 | Fielder et al. | 704/229 |
| 6,487,535 | B1 | 11/2002 | Smyth et al. | |
| 6,591,241 | B1 * | 7/2003 | Absar et al. | 704/504 |
| 7,340,391 | B2 * | 3/2008 | Herre et al. | 704/200.1 |
| 7,356,748 | B2 | 4/2008 | Taleb | |
| 7,437,299 | B2 * | 10/2008 | Aarts et al. | 704/500 |
| 2003/0061055 | A1 | 3/2003 | Taori et al. | |
| 2003/0115041 | A1 | 6/2003 | Chen et al. | |
| 2003/0115052 | A1 | 6/2003 | Chen et al. | |

FOREIGN PATENT DOCUMENTS

| | | |
|---|---|---|
| EP | 0559383 | 9/1993 |
| EP | 0965123 | 1/2003 |
| JP | 11-032399 | 2/1999 |
| JP | 2001-184090 | 7/2001 |
| JP | 2002-255899 | 9/2001 |
| JP | 2002-132295 | 5/2002 |
| JP | 2003-345398 | 12/2003 |
| WO | 03/090206 | 10/2003 |
| WO | 03/090208 | 10/2003 |

OTHER PUBLICATIONS

Christof Faller and Frank Baumgarte; "Binaural Cue Coding Applied to Stereo and Multi-Channel Audio Compression;" AES Convention Paper 5574, 112$^{th}$ Convention, Munich, Germany, May 10-13, 2002.

Christof Faller and Frank Baumgarte; "Efficient Representation of Spatial Audio Using Perceptual Parametrization;" Applications of Signal Processing to Audio and Acoustics; 2001 IEEE Workshop on Publication date Oct. 21-24, 2001; pp. W2001-1 through W2001-4.

International Search Report and Written Opinion mailed Mar. 17, 2005 in corresponding PCT Application PCT/SE2004/001907.

Office action mailed Jan. 26, 2009 in co-pending U.S. Appl. No. 11/011,765.

Japanese official action, dated May 7, 2008 in corresponding Japanese Application No. 2006-518596.

Summary of the Japanese official action, dated May 7, 2008 in corresponding Japanese Application No. 2006-518596.

Office Action mailed Jul. 31, 2009 in co-pending U.S. Appl. No. 11/011,765.

Herre, J. et al., Intensity Stereo Coding, AES Convention: 96 (Feb. 1994) Paper No. 3799; Affiliation: Fraunhofer Gesellschaft, Institute fur Integrierte Schaultungen, Erlangen, Germany.

Canadian official action, Jun. 17, 2008, in corresponding Canadian Application No. 2,527,971.

U.S. Appl. No. 11/011,765, filed Dec. 15, 2004; Inventor: Johansson et al.

L.R. Rabiner et al., Digital Processing of Speech Signals, Upper Saddle River, New Jersey: Prentice Hall, Inc., 1978, pp. 116-130.

European official action, Feb. 22, 2010, in corresponding European Application No. 04 809 080.7-225.

* cited by examiner

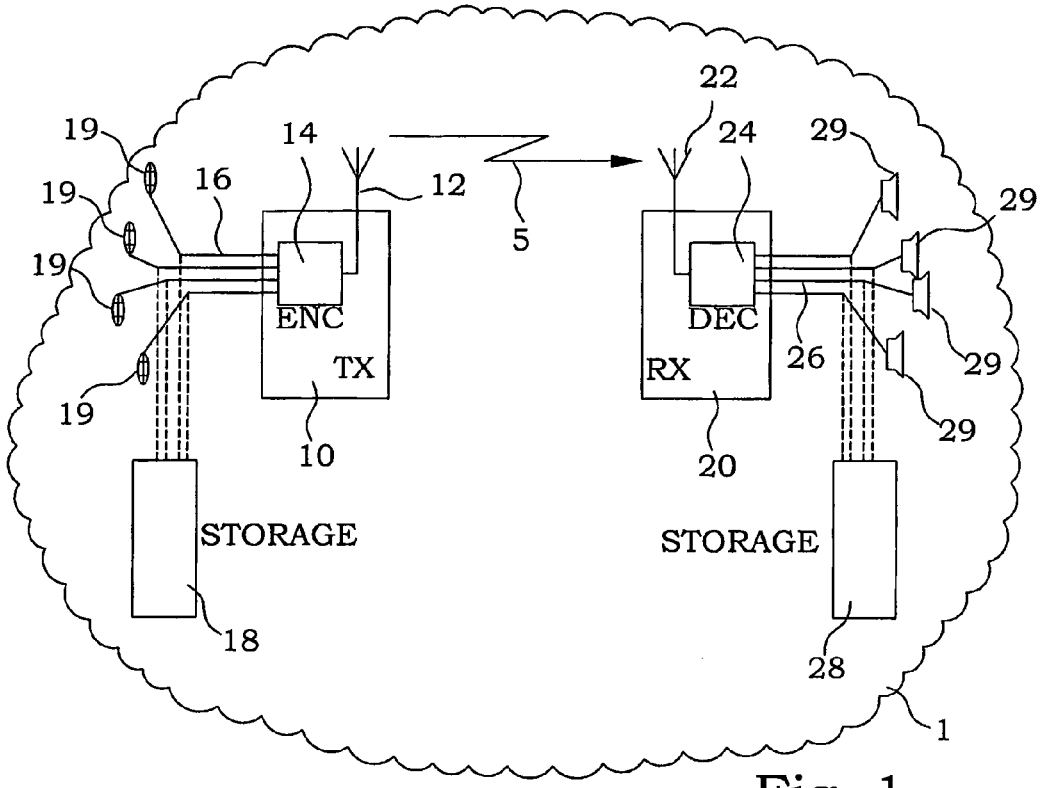
Fig. 1
Fig. 2a
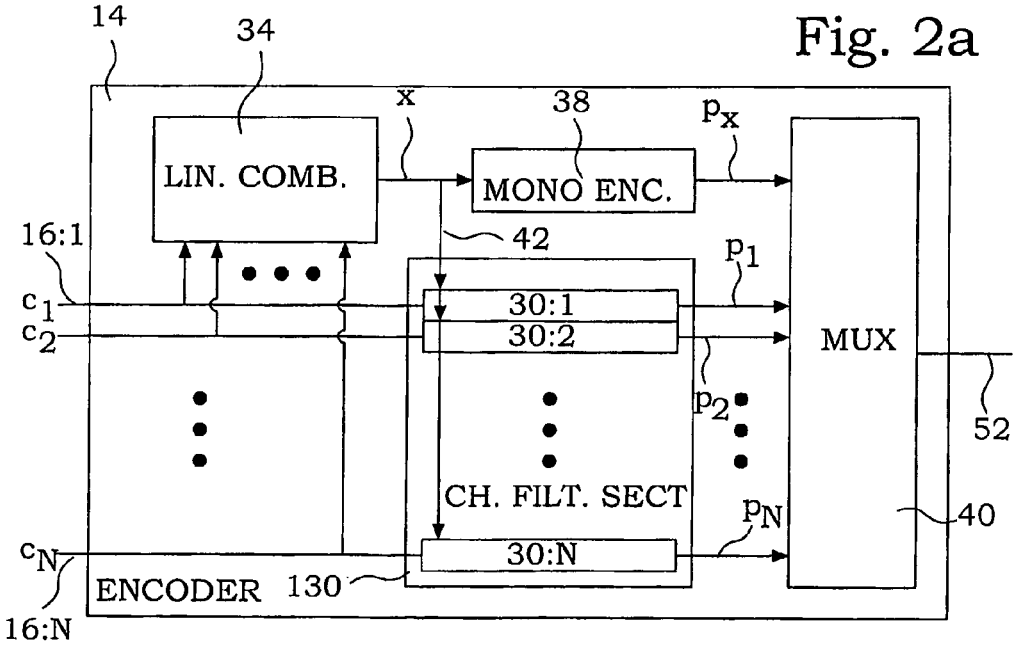

Fig. 8
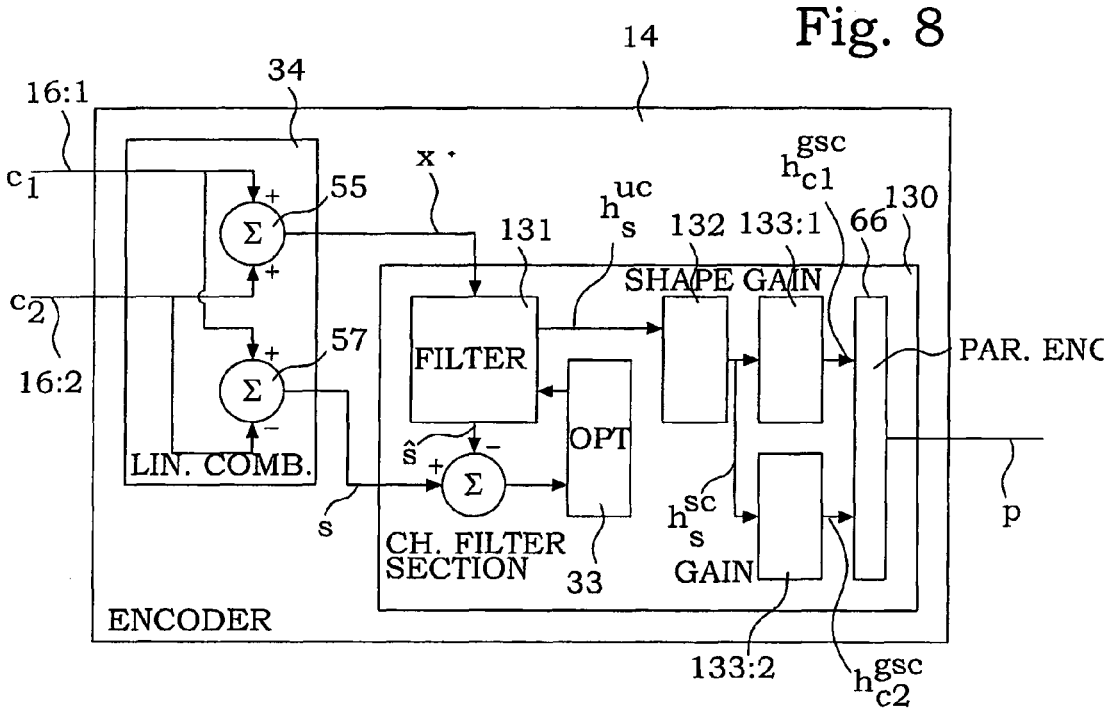
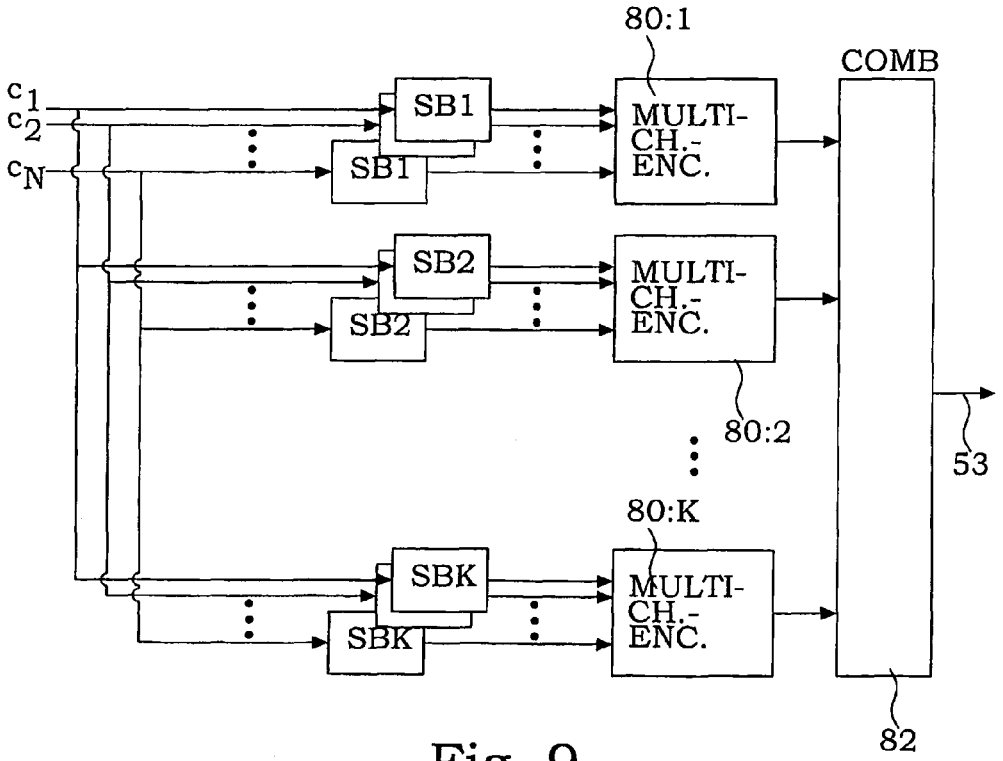
Fig. 9

CONSTRAINED FILTER ENCODING OF POLYPHONIC SIGNALS

CROSS REFERENCE TO RELATED APPLICATION

This application is based on, and claims domestic priority benefits under 35 U.S.C. 119(e) from, Provisional Application No. 60/530,650, filed Dec. 19, 2003, the entire content of which is hereby incorporated by reference.

TECHNICAL FIELD

The present invention relates in general to encoding of audio signals, and in particular to encoding of multi-channel audio signals.

BACKGROUND

There is a high market need to transmit and store audio signals at low bit rate while maintaining high audio quality. Particularly, in cases where transmission resources or storage is limited low bit rate operation is an essential cost factor. This is typically the case, e.g. in streaming and messaging applications in mobile communication systems such as GSM, UMTS, or CDMA.

Today, there are no standardized codecs available providing high stereophonic audio quality at bit rates that are economically interesting for use in mobile communication systems. What is possible with available codecs is monophonic transmission of the audio signals. To some extent also stereophonic transmission is available. However, bit rate limitations usually require limiting the stereo representation quite drastically.

The simplest way of stereophonic or multi-channel coding of audio signals is to encode the signals of the different channels separately as individual and independent signals. Another basic way used in stereo FM radio transmission and which ensures compatibility with legacy mono radio receivers is to transmit a sum and a difference signal of the two involved channels.

State-of-the-art audio codecs, such as MPEG-1/2 Layer III and MPEG-2/4 AAC make use of so-called joint stereo coding. According to this technique, the signals of the different channels are processed jointly, rather than separately and individually. The two most commonly used joint stereo coding techniques are known as "Mid/Side" (M/S) stereo coding and intensity stereo coding, which usually are applied on sub-bands of the stereo or multi-channel signals to be encoded.

M/S stereo coding is similar to the described procedure in stereo FM radio, in a sense that it encodes and transmits the sum and difference signals of the channel sub-bands and thereby exploits redundancy between the channel sub-bands. The structure and operation of an encoder based on M/S stereo coding is described, e.g. in U.S. Pat. No. 5,285,498 by J. D. Johnston.

Intensity stereo on the other hand is able to make use of stereo irrelevancy. It transmits the joint intensity of the channels (of the different sub-bands) along with some location information indicating how the intensity is distributed among the channels. Intensity stereo does only provide spectral magnitude information of the channels. Phase information is not conveyed. For this reason and since the temporal inter-channel information (more specifically the inter-channel time difference) is of major psycho-acoustical relevancy particularly at lower frequencies, intensity stereo can only be used at high frequencies above e.g. 2 kHz. An intensity stereo coding method is described, e.g. in the European patent 0497413 by R. Veldhuis et al.

A recently developed stereo coding method is described, e.g. in a conference paper with the title "Binaural cue coding applied to stereo and multi-channel audio compression", 112th AES convention, May 2002, Munich, Germany by C. Faller et al. This method is a parametric multi-channel audio coding method. The basic principle is that at the encoding side, the input signals from N channels $c_1, c_2, \ldots c_N$ are combined to one mono signal m. The mono signal is audio encoded using any conventional monophonic audio codec. In parallel, parameters are derived from the channel signals, which describe the multi-channel image. The parameters are encoded and transmitted to the decoder, along with the audio bit stream. The decoder first decodes the mono signal m' and then regenerates the channel signals $c_1', c_2', \ldots, c_N'$, based on the parametric description of the multi-channel image.

The principle of the Binaural Cue Coding (BCC) method is that it transmits the encoded mono signal and so-called BCC parameters. The BCC parameters comprise coded inter-channel level differences and inter-channel time differences for sub-bands of the original multi-channel input signal. The decoder regenerates the different channel signals by applying sub-band-wise level and phase adjustments of the mono signal based on the BCC parameters. The advantage over e.g. M/S or intensity stereo is that stereo information comprising temporal inter-channel information is transmitted at much lower bit rates.

A problem with the state-of-the-art multi-channel coding techniques described above is that they require high bit rates in order to provide good quality. Intensity stereo, if applied at low bit rates as low as e.g. only a few kbps suffers from the fact that it does not provide any temporal inter-channel information. As this information is perceptually important for low frequencies below e.g. 2 kHz, it is unable to provide a stereo impression at such low frequencies.

BCC is able to reproduce the multi-channel image even at low frequencies at low bit rates of e.g. 3 kbps since it also transmits temporal inter-channel information. However, this technique requires computational demanding time-frequency transforms on each of the channels, both at the encoder and the decoder. Moreover, BCC optimizes the mapping in a pure mathematical manner. Characteristic artifacts immanent in the coding method will, however, not disappear.

Another technique, described in U.S. Pat. No. 5,434,948 by C. E. Holt et al. uses a similar approach of encoding the mono signal and side information. In this case, side information consists of predictor filters and optionally a residual signal. The predictor filters, estimated by a least-mean-square algorithm, when applied to the mono signal allow the prediction of the multi-channel audio signals. With this technique one is able to reach very low bit rate encoding of multi-channel audio sources, however, at the expense of a quality drop.

An approach similar to the above filtering approach is described in WO 03/090206 by Breebaart and Groenendaal. However, this approach uses a fixed filter applied to the mono signal and combined together with the non filtered mono signal via a matrixing operation. The matrixing operation is dependent upon a received correlation parameter and a received level parameter. The objective of such signal synthesis is to restore the correlation and the level difference of the original two channels. Because of the inherently fixed filtering operation, the signal synthesis has a very limited potential for signal reproduction and does not adapt to the signal characteristics. The approach can be regarded as an extension of the intensity stereo coding method discussed above, in which now a temporal component is conveyed to the decoder. Still, only the level and the correlation parameters allow a certain degree of adaptivity through a matrixing operation. This operation consists of a mere rotation and scaling of statically filtered signals, thus limiting the polyphonic reproduction ability. Another drawback of the approach is the fact that it is not based on a fidelity criterion, e.g. signal-to-noise ratio, which limits its scalability to transparent quality.

Finally, for completeness, a technique is to be mentioned that is used in 3D audio. This technique synthesizes the right and left channel signals by filtering sound source signals with so-called head-related filters. However, this technique requires the different sound source signals to be separated and can thus not generally be applied for stereo or multi-channel coding.

SUMMARY

Although the predictor filters are known to be optimal in the least-mean-square sense, they do not always fully restore the perceptual characteristics of the original multi-channel signals. In e.g. the case of stereo encoding, stereo image instability may occur, where the sound jumps randomly between left to right. Furthermore, spectral nulls may cause instabilities and lead to a filter whose frequency response at these frequencies is aberrant. This may cause the filter to perform unnecessary amplification in certain regions and lead to very annoying audible artifacts, especially if the signals are low-pass or high-pass filtered.

An object of the present invention is to provide a method and device for multi-channel encoding that improves the perceptual quality of the audio signal. A further object of the present invention is to provide such a method and device, which requires low bit rate representation.

The above objects are achieved by methods and devices according to the enclosed patent claims. In general, at the encoder side, the signals of the different channels are combined into one main signal. A set of adaptive filters, preferably one for each channel, is derived. When a filter is applied to the main signal it reconstructs the signal of the respective channel under a perceptual constraint. The perceptual constraint is a gain and/or shape constraint. The gain constraint allows the preservation of the relative energy between the channels while the shape constraint allows stereo image stability, e.g. by avoiding unnecessary filtering of spectral nulls. The transmitted parameters are the main signal, in encoded form, and the parameters of the adaptive filters, preferably also encoded. The receiver reconstructs the signal of the different channels by applying the adaptive filters and possibly some additional post-processing.

An advantage with the present invention is that perceptual artifacts are reduced when decoding audio signals. The required transmission bit rate is at the same time also kept at a very low level.

BRIEF DESCRIPTION OF THE DRAWINGS

The invention, together with further objects and advantages thereof, may best be understood by making reference to the following description taken together with the accompanying drawings, in which:

FIG. 1 is a block scheme of a system for transmitting multi-channel signals;

FIG. 2*a* is a block diagram of an embodiment of an encoder in a transmitter according to the present invention;

FIG. 3*b* is a block diagram of another embodiment of a decoder in a is receiver according to the present invention;

FIG. 8 is a block diagram of an embodiment of an encoder employing partial combined encoding of a stereo signal;

FIG. 9 is a block diagram illustrating the use of division in frequency sub-bands;

DETAILED DESCRIPTION

Figure 2B:
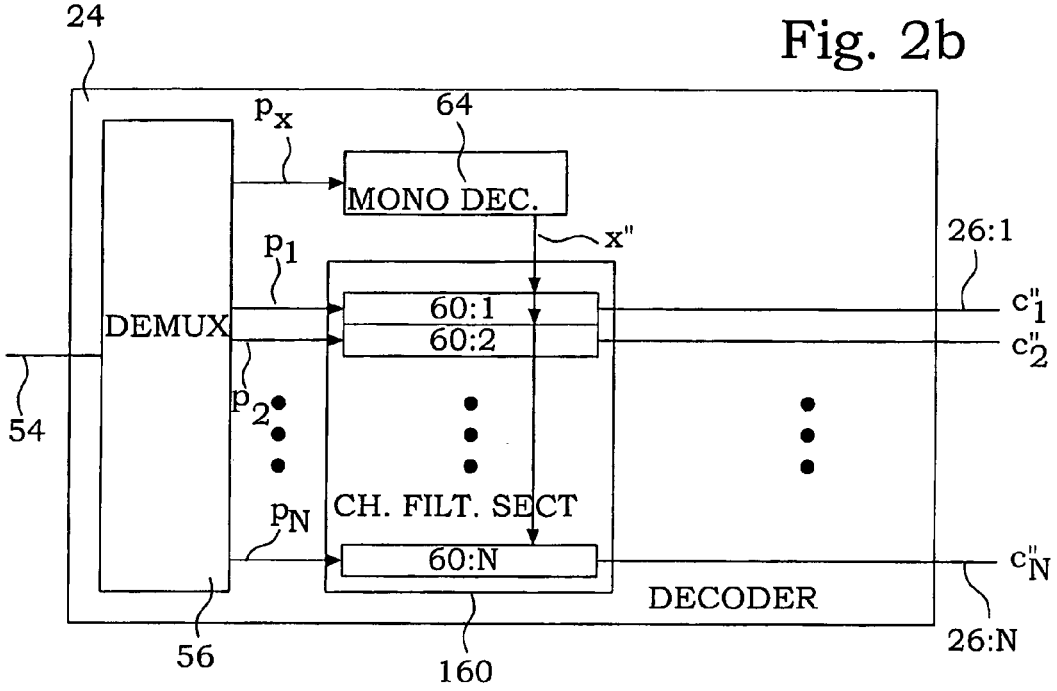
FIG. 2*b* is a block diagram of an embodiment of a decoder in a receiver according to the present invention.

FIG. 1 illustrates a typical system 1, in which the present invention advantageously can be utilized. A transmitter 10 comprises an antenna 12 including associated hardware and software to be able to transmit radio signals 5 to a receiver 20. The transmitter 10 comprises among other parts a multi-channel encoder 14, which transforms signals of a number of input channels 16 into output signals suitable for radio transmission. Examples of suitable multi-channel encoders 14 are described in detail further below. The signals of the input channels 16 can be provided from e.g. an audio signal storage 18, such as a data file of digital representation of audio recordings, magnetic tape or vinyl disc recordings of audio etc. The signals of the input channels 16 can also be provided in "live", e.g. from a set of microphones 19. The audio signals are digitized, if not already in digital form, before entering the multi-channel encoder 14.

At the receiver 20 side, an antenna 22 with associated hardware and software handles the actual reception of radio signals 5 representing polyphonic audio signals. Here, typical functionalities, such as e.g. error correction, are performed. A decoder 24 decodes the received radio signals 5 and transforms the audio data carried thereby into signals of a number of output channels 26. The output signals can be provided to e.g. loudspeakers 29 for immediate presentation, or can be stored in an audio signal storage 28 of any kind.

The system 1 can for instance be a phone conference system, a system for supplying audio services or other audio applications. In some systems, such as e.g. the phone conference system, the communication has to be of a duplex type, while e.g. distribution of music from a service provider to a subscriber can be essentially of a one-way type. The transmission of signals from the transmitter 10 to the receiver 20 can also be performed by any other means, e.g. by different kinds of electromagnetic waves, cables or fibers as well as combinations thereof.

FIG. 2*a* illustrates one embodiment of a multi-channel encoder 14 according to the present invention. A number of channel signals $c_1, c_2, \ldots, c_N$ are received at separate inputs 16:1-16:N.

The channel signals are connected to a linear combination unit 34. In the present embodiment, all channel signals are summed together to form a mono signal x. However, any predetermined linear combination of one or more of the channel signals may be used as an alternative, including pure channel signals. However, a pure sum will simplify most mathematical operations. The mono signal x is provided as an input signal 42 to a channel filter section 130. Furthermore, the mono signal x is provided to, and encoded in, a mono signal encoder 38 to provide encoding parameters $p_x$ representing the mono signal x. The mono signal encoder operates according to any suitable mono signal encoding technique. Many such techniques are available in known technology. The actual details of the encoding technique are not of importance for enabling the present invention and is therefore not further discussed.

The channel signals are also connected to the channel filter section 130. In the present embodiment, each channel signal is connected to a respective filter adaptation unit 30:1-30:N. The filter adaptation units perform a reconstruction of a respective channel signal when applied to the mono signal x. Coefficients of the filter adaptation units 30:1-30:N are according to the present invention optimized under a perceptual constraint. However, the optimized coefficients of the filter adaptation units 30:1-30:N may also be obtained at least partly in a joint optimization of two or more of the channel signals.

The output of the channel filter section 130 comprises N sets of filter parameters $p_1$-$p_N$. These filter parameters $p_1$-$p_N$ are typically encoded separately or jointly to be suitable for transmission. The filter parameters $p_1$-$p_N$ and the mono signal x are sufficient to enable reconstruction of all channels signals. The encoded filter parameters $p_1$-$p_N$ and the encoding parameters $p_x$ representing the mono signal x are in the present embodiment multiplexed in a multiplexor 40 into one output signal 52, ready for transmission.

FIG. 2*b* illustrates one embodiment of a multi-channel decoder 24 according to the present invention. The decoder 24 in FIG. 2*b* is suitable for decoding multi-channel signals encoded by the encoder of FIG. 2*a*. An input signal 54 is received and provided to a demultiplexor 56, which divides the input signal 54 into encoding parameters $p_x$ representing the mono signal x and a number of sets of encoded filter parameters $p_1$-$p_N$.

The encoding parameters $p_x$ representing the mono signal x are provided to a mono signal decoder 64, in which the encoding parameters $p_x$ representing the mono signal x are used to generate a decoded mono signal x" according any suitable decoding technique associated with the encoding technique used in FIG. 2*a*. Many such techniques are available in known technology. The actual details of the decoding technique are not of importance for enabling the present invention and is therefore not further discussed. The decoded mono signal x" is provided to a channel filter section 160.

The encoded filter parameters are also provided to the channel filter section 160, where they are decoded and used to define channel filters 60:1-60:N. The so defined respective channel filters 60:1-60:N are applied to the decoded mono signal x" whereby respective channel signals $c''_1$-$c''_N$ are reconstructed and provided at outputs 26:1-26:N.

In most embodiments of the present disclosure, a mono signal is used as a main signal for regenerating the channel signals at the encoding or decoding. However, in a general approach, any predetermined linear combination of signals selected among the channel signals may be used as such a main signal. The optimum choice of predetermined linear combination depends on the actual application and implementation. A single channel signal can also constitute a possible such predetermined linear combination.

Figure 3A:
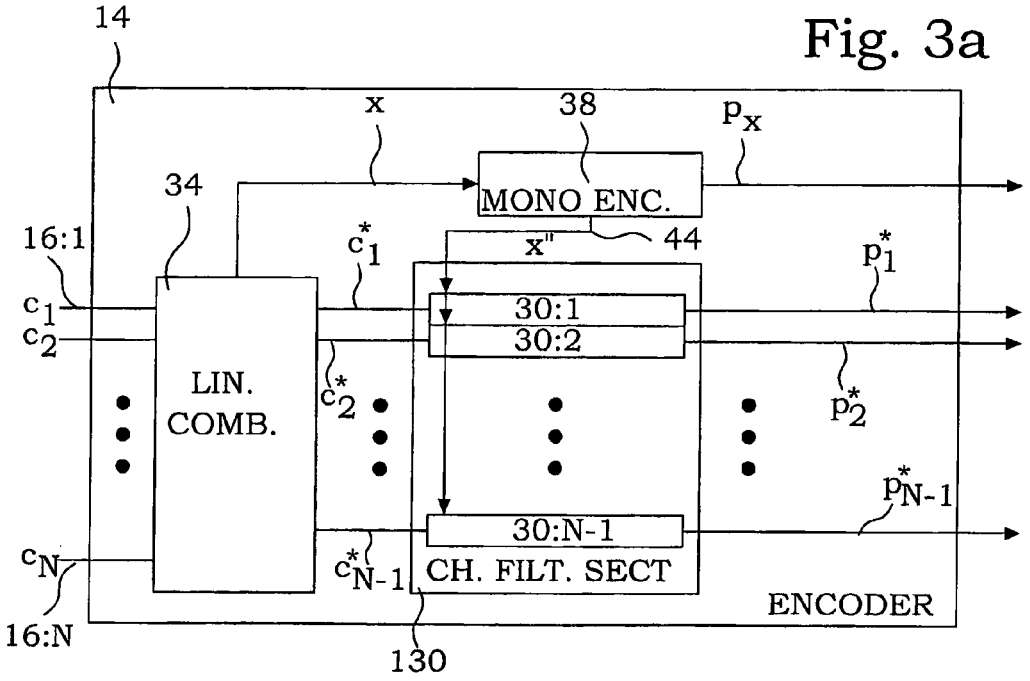
FIG. 3*a* is a block diagram of another embodiment of an encoder in a transmitter according to the present invention.

Another embodiment of a multi-channel encoder 14 according to the present invention is illustrated in FIG. 3*a*. Similar parts are denoted by similar reference numbers and only the differences are discussed below.

The linear combination unit 34 provides as earlier a predetermined linear combination of the channel signals to the mono signal encoder 38. However, in this embodiment, the signal associated with the mono signal x is instead a decoded version x" of the encoding parameters $p_x$ representing the mono signal x. Such an arrangement, referred to as a closed loop approach, will allow for certain compensations of mono signal encoding inaccuracies, as described further below.

The linear combination unit 34 of the present embodiment also combines the channel signals in N−1 predetermined linear combinations $c^*_1$-$c^*_{N-1}$, which serves as actual input signals to the channel filter section 130. The N-1 predetermined linear combinations $c^*_1$-$c^*_{N-1}$ should be mutually linear independent. The linear combinations $c^*_1$-$c^*_{N-1}$ do not necessarily comprise any contribution from all channel signals. The term "linear combination" should in this context be used as also comprising the special cases where a factor of a component can be set to zero. In fact, in the most simple set-up, the linear combinations $c^*_1$-$c^*_{N-1}$ can be identical to the channel signals $c_1$-$c_{N-1}$. By utilizing a decoded mono signal x" at the decoder side, the original channel signals can be recovered.

The modified channel signals are also in this embodiment connected to the channel filter section 130, in which N−1 sets of filter coefficients are deduced, now corresponding to the modified channel signals. The coefficients of the filter adaptation units 30:1-30:N are according to the present invention optimized under a perceptual constraint.

The output of the channel filter section 130 comprises N−1 sets of filter parameters $p^*_1$-$p^*_{N-1}$. These filter parameters $p^*_1$-$p_{N-1}$ are typically encoded separately or jointly to be suitable for transmission. The encoded filter parameters $p^*_1$-$p^*_{N-1}$ and the encoding parameters $p_x$ representing the mono signal x are in the present embodiment transmitted separately.

FIG. 3*b* illustrates another embodiment of a multi-channel decoder 24 according to the present invention. The decoder 24 in FIG. 3*b* is suitable for decoding multi-channel signals encoded by the encoder of FIG. 3*a*. Encoding parameters $p_x$ representing the mono signal x and a set of encoded filter parameters $p^*_1$-$p^*_{N-1}$ are received. The encoding parameters $p_x$ representing the mono signal x are used to generate a decoded mono signal x" in a mono signal decoder 64 in analogy with previous embodiment. The filter parameters $p^*_1$-$p^*_{N-1}$ are likewise provided to the channel filter section 160 for obtaining N−1 decoded modified channel signals $c^*_1$-$c^*_{N-1}$. A linear combination unit 74 is then used to provide reconstructed channel signals $c''_1$-$c''_N$ from the modified channel signals $c^*_1$-$c^*_{N-1}$ and the decoded mono signal x".

In order to realize the important relevance of the perceptual constraints, an example of prior art filter encoding will be described more in detail, basically referring to the U.S. Pat. No. 5,434,948. This multi-channel encoding allows low bit rates if the transmission of residual signals is omitted. To derive the channel reconstruction filter, an error minimization procedure based on a least-mean-square or weighted least-mean-square concept calculates the filters such that its output signal $\hat{c}(n)$ best matches the target signal c(n).

In order to compute the filter, several error measures may be used. The mean square error or the weighted mean square error are well known and are computationally cheap to implement. According to the least mean square approach, the filter $\underline{h}_c^{uc}$, where "uc" refers to "unconstrained", is valid for one frame of data and chosen such that it minimizes the squared error between the target signal and the filter output, i.e. the square of the difference $r_{uc}(n)=c(n)-\hat{c}_{uc}(n)$, n indexing the samples of a data frame. This error is expressed as:

$$e_{LMS} = \sum_{n=frame\ start}^{frame\ end} r^{ue}(n)^2.$$

This leads to the following linear equation system for the filter coefficient vector $\underline{h}_c^{uc}$:

$$\underline{\underline{R}}_{xx} \cdot \underline{h}_c^{uc} = \underline{r}_{xc}$$

where $\underline{\underline{R}}_{xx}$ is the symmetric covariance matrix of the mono signal x(n):

$$\underline{\underline{R}}_{xx} = \left[ \sum_{n=frame\ start}^{frame\ end} x(n-k)x(n-j) \right], \quad j, k \in I,$$

and where $\underline{r}_{xc}$ is a vector of cross-correlations of signals x(n) and c(n):

$$\underline{r}_{xx} = \left[ \sum_{n=frame\ start}^{frame\ end} x(n-k)c(n) \right], \quad k \in I.$$

However, as mentioned further above, the perceptual characteristics may not completely be determined by a pure mathematical minimization.

One very important perceptual characteristic of multi-channel signals is their energy and especially the relative levels between the multi-channel audio signals. In the case of stereo encoding with prior-art methods, annoying stereo image instability where the sound source jumps periodically from left to right may be the result. Moreover, since only one filter is needed in stereo encoding, no direct control over the left and right predictions is achieved. According to the present invention, a gain constraint is therefore advantageously utilized during optimization procedures. In that context, it may be noted that one filter per channel basically is necessary, c.f. FIG. 2*a* and FIG. 2*b* above.

In certain situations, the predicted channels may have no frequency content above or below a certain frequency. This occurs if, for instance, the channel is high-pass filtered, or results from a band-splitting procedure. Spectral nulls may cause instabilities and lead to filter responses that produces unnecessary amplification and low frequency audible artifacts. According to the present invention, a shape constraint is therefore advantageously utilized during optimization procedures.

Figure 4:
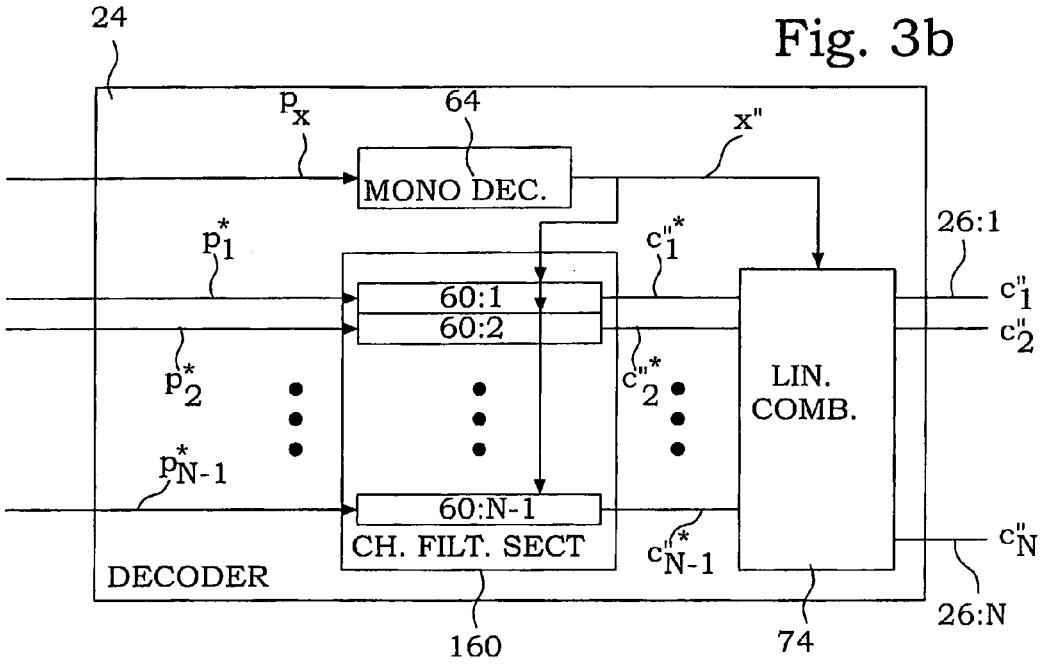
FIG. 4 is a block diagram of an embodiment of a filter adaptation unit according to the present invention.
Figure 4:
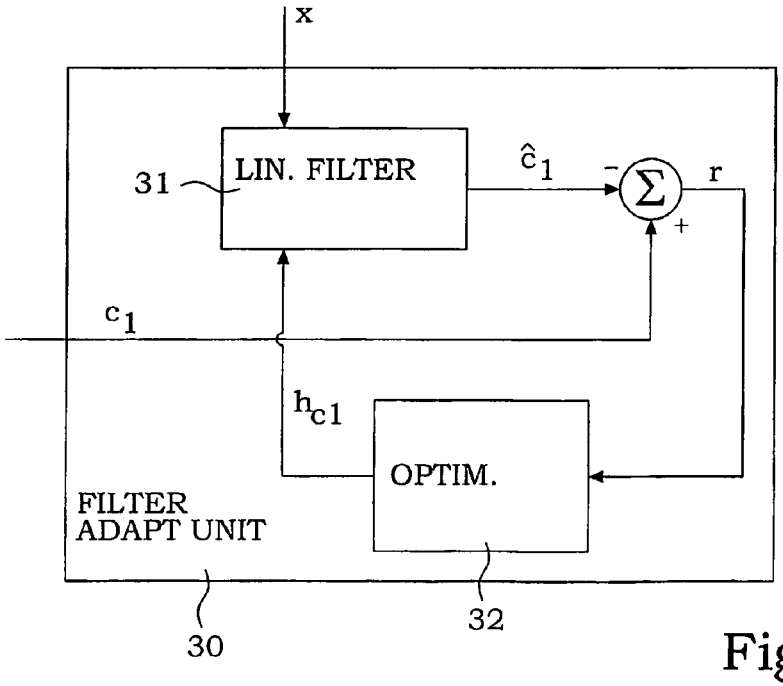

FIG. 4 illustrates the basic ideas of the constrained minimization procedure at the encoder side according to the present invention in an embodiment having two channels (the stereo case) and a linear filter 31. A filter 31 responsive for reconstruction of channel c1 having filter coefficients $\underline{h}_{c1}$, is derived according to a constrained error minimization procedure in an optimizing unit 32. The filter $\underline{h}_{c1}$ takes as input the combined channel signal, i.e. the mono signal x(n), which in this embodiment is a linear combination of the two channel signals c1 and c2:

$$x(n)=\gamma_{c1} \cdot c1(n)+\gamma_{c2} \cdot c2(n),$$

and derives from it the output signal $\hat{c}1(n)$. The factors $\gamma_{c1}$ and $\gamma_{c2}$ determine how the channel signals are combined. One possibility is to set $\gamma_{c1}$ to a factor $2\gamma$ and $\gamma_{c2}$ to $2(1-\gamma)$. In this case, the mono signal will be a weighted sum of the channels. In particular, a suitable setting is $\gamma=0.5$, in which case both channels are equally weighted. Another suitable setting may be $\gamma_{c1}=-\gamma_{c2}$, in which case the mono signal is the difference of the channel signals.

The weighted combination of the individual channel signals to form the mono signal can in general even be the combination of filtered versions of the respective channel signals. Such an approach will be called pre-filtering.

This can be useful if the approach is implemented in the excitation domain or in general a weighted signal domain. For instance, the channels can be pre-filtered by a LPC (Linear Predictive Coding) residual filter of the mono signal.

In the following, the mono and left and right channel will be assumed to be in general some pre-filtered versions of the real mono, left and right channels. When restoring the channels, the step of post-filtering with the mono LPC synthesis filter would be needed in order to get back to the signal domains.

In the following, the case $\gamma_{c1}=½$ and $\gamma_{c2}=½$ is discussed more in detail.

In case of $\underline{h}_{c1}$ being an FIR (Finite Impulse Response) filter, $\hat{c}1(n)$ is a linear combination of delayed versions of signal x(n):

$$c1(n) = \sum_{k \in I} h_{c1}(k) \cdot x(n-k),$$

the index set being $I=[i_{min} \ldots i_{max}]$. The filter parameters $p_1$ comprise the filter coefficients $\underline{h}_{c1}$ and maybe necessary additional data defining the filter.

Figure 5:
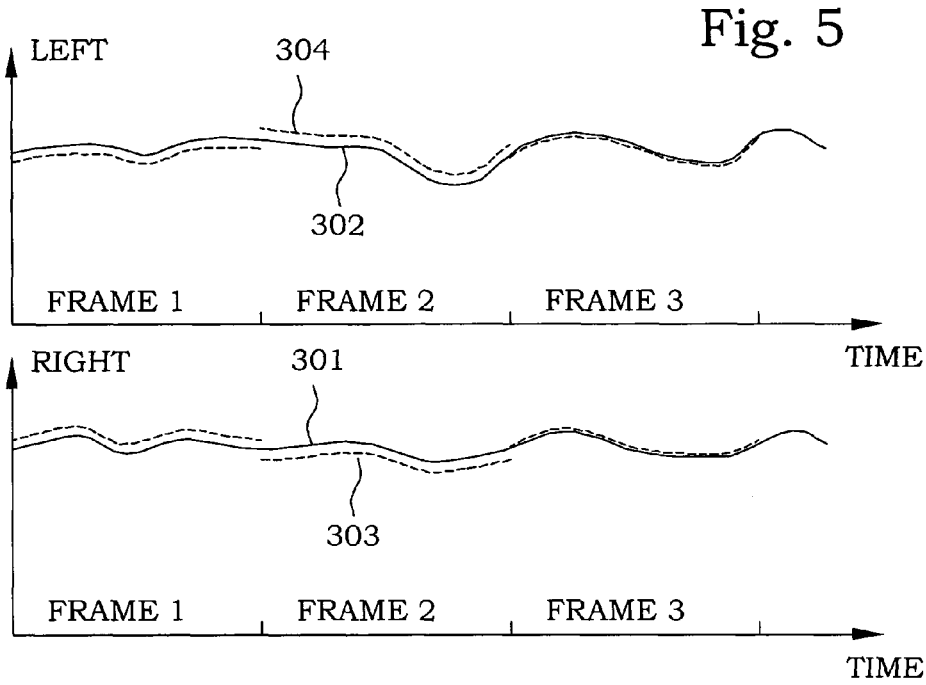
FIG. 5 are diagrams illustrating the effects of insufficient reproduction of side signals in a prior-art system.

If applying e.g. the encoding method presented in U.S. Pat. No. 5,434,948, the difference signal of two channel signals is reproduced by a filter. In FIG. 5, the right and left signals are illustrated by the curves 301 and 302, respectively. Assume that the representation is not ideal, giving a slightly larger difference than the target difference over the entire frame. This will lead to a reproduced right signal 303 at the decoder side that is slightly lower than the original right signal, and a reproduced left signal 304 that is slightly higher than the original left signal. The perception of such an artifact is that the volume of the right channel is decreased and the volume of the left channel is increased. If such artifacts moreover vary in time, the sound will swing back and forth between the right and left channel. A gain constraint may improve such a situation.

There are several ways of implementing the gain constraint. One possible approach is to have a hard constraint, i.e. exact energy match between the original channel and the estimated channel, or to impose a loose gain constraint such as the output channel has a prescribed energy $E_{c1}$, which is not necessarily equal to the original channel signal energy.

The constrained minimization problem can easily be solved by Lagrange method, i.e. the Lagrange functional:

$$L(\lambda) = \sum_{n=frame\ start}^{frame\ end} r(n)^2 + \lambda \left( E_{c1} - \sum_{n=frame\ start}^{frame\ end} \hat{c}1(n)^2 \right)$$

The optimal solution gives a filter $\underline{h}_{c1}$ that is proportional to the unconstrained filter $\underline{h}_{c1}^{uc}=\underline{\underline{R}}_{xx}^{-1}\cdot\underline{r}_{xc1}$. The proportionality factor is:

$$g_n = \sqrt{\frac{E_{cl}}{\sum_{n=frame\ start}^{frame\ end} \hat{c}1^{ge}(n)^2}}.$$

The gain constrained filter thereby becomes $\underline{h}_{c1}^{gc}=g_{c1}\underline{h}_{c1}^{uc}$.

Figure 6:
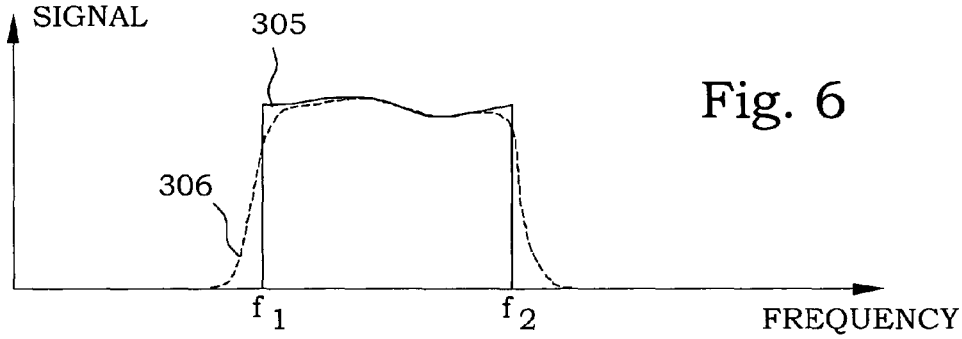
FIG. 6 is a diagram illustrating effects of spectral nulls in prior-art systems.

If the present encoder principle is used in a limited frequency band, a channel signal may look like curve 305 of FIG. 6. No intensity is present below frequency $f_1$ or above frequency $f_2$. However, a pure mathematical optimization gives rise to a curve 306, which presents some limited power also below and above the frequencies $f_1$ and $f_2$, respectively. Such artifacts are perceived.

In order to impose a certain spectral shape on the filter, a set of linear constraints have to be imposed on the filter. These constraints should in general be of a number less than the number of coefficients of the filter.

For instance, if one wants to set a constraint of a spectral null at 0 kHz, then a suitable constraint is:

$$\sum_{k\in l} h_c(k) = \underline{1}^T\underline{h}_c = 0.$$

In general, the shape constraint can be formulated by a matrix and a vector such that $$\underline{\underline{W}}_c^T\underline{h}_c = \underline{w}_c.$$

From the theory of constrained least squares, the optimal filter satisfying these constraints is:

$$\underline{h}_c^{uc} = \underline{h}_c^{uc} + \underline{\underline{R}}_{xx}^{-1}\underline{\underline{W}}_c\left[\underline{\underline{W}}_c^T\underline{\underline{R}}_{xx}^{-1}\underline{\underline{W}}_c\right]^{-1}(\underline{w}_c - \underline{\underline{W}}_c^T\underline{h}_c^{uc}).$$

This constraint is especially useful when it is known a priori that the channel has no frequency content in a certain frequency range.

The gain and shape constraints can also be combined. In such a case, the shape constraint is preferably first applied and the gain constraint is then added as a factor, according to $$\underline{h}_e^{gec} = g_c h_c^{sc},\ g_e = \sqrt{\frac{E_c}{\sum_{n=frame\ start}^{frame\ end} \hat{c}^{sc}(n)^2}}.$$

The filters depend on the unconstrained filter and the latter obeys, since c1($n$)+c2($n$)=2x(n), the relation:

$$\underline{h}_{c1}^{uc} + \underline{h}_{c2}^{uc} = 2\delta, \tag{1}$$

where δ denotes the identity filter. Useful properties can be derived for the shape-constrained filters, if the constraints on the two channels are identical, $$\underline{\underline{W}}_{c1} = \underline{\underline{W}}_{c2} = \underline{\underline{W}},\ \underline{w}_{c1} = \underline{w}_{c2} = \underline{w}$$

then $$\underline{h}_{c1}^{sc} + \underline{h}_{c2}^{sc} = 2\delta + \underline{\underline{R}}_{xx}^{-1}\left[\underline{\underline{W}}^T\underline{\underline{R}}_{xx}^{-1}\underline{\underline{W}}\right]^{-1}\left(\underline{w} - 2\underline{\underline{W}}^T\delta\right).$$

This equation is useful for bit rate reduction when encoding the channel filters, since it shows that the channel filters are related by quantities that are available at the decoder side.

Figure 7:
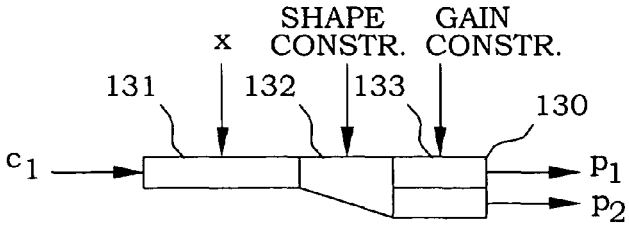
FIG. 7 is a block diagram illustrating combining possibilities in channel filter sections according to the present invention.

The relations between the shape constrained filters also opens up for a rational computation of the filters. In FIG. 7, an illustration shows that one c1 out of two channels c1, c2 is reproduced by applying the mono signal x to an unconstrained filter 131. The result of the unconstrained filter is modified depending on shape constraints in a shape constraint section 132. From the shape constrained filter for the c1 channel, also the shape constrained filter of channel c2 can be calculated and provided to separate gain constraint sections 133 for each channel.

A more detailed block scheme of another embodiment using a side signal for applying the shape constraint is illustrated in FIG. 8. Two channel signals c1 and c2 are combined in addition means 55, 57 of a linear combination unit 34 to a mono signal x and a side signal s. A channel filter section 130 comprises an unconstrained parametric filter 131, which applied to the mono signal x reproduces an estimate of the side signal $\bar{s}$. In an unconstrained optimizing unit 33, the filter coefficients are adapted to give the minimum difference between s and $\hat{s}$. The filter obtained in this manner $\underline{h}_s^{uc}$, is provided to a shape constraint section 132, basically according to the discussions further above. A shape-constrained filter $\underline{h}^{uc}$, for the side signal is created. From the relation (1) between channel filters in a stereo application, a shape-constrained filter for each channel signal is calculated, based on the shape-constrained filter $\underline{h}_s^{sc}$ for the side signal. These filters, or rather the coefficients thereof, are provided to a respective gain constraint section 133:1, 133:2. A gain factor for each channel signal is calculated, and the two filters are provided to a parameter encoding section 66, where the parameters of the two filters are jointly encoded.

After calculation of the constrained channel filters $\underline{h}_{c1}$ and $\underline{h}_{c2}$, they are quantized and encoded in a representation, which is suitable for transmission to the receiver. Typically, the coefficients of the filters are quantized using scalar or vector quantizers and the quantizer indexes are transmitted. The quantizers may also implement prediction, which is very beneficial for bit rate reduction especially in this scenario.

Making use of the complementarities of the filters may further reduce the bit rate since only one of the filters $\underline{h}_{c1}$ or $\underline{h}_{c2}$ or a linear combination of them is quantized and transmitted while the gains $g_{c1}$ and $g_{c2}$ are jointly vector quantized and transmitted separately. Such a transmission can be carried out at bit rates as low as, e.g. 1 kbps.

The receiver first decodes the transmitted mono signal and channel filters. Then, it regenerates the different channel signals by filtering the mono signal through the respective channel filter. Preferably, in the stereo case, the completeness property is used, and the coefficients are recombined to produce the filters $\underline{h}_{c1}$ and $\underline{h}_{c2}$.

Certain post-processing steps that further improve the quality of the reconstructed multi-channel signal may follow the re-generation of the different channels signals.

It is sometimes beneficial to smooth the gain of the shape-constrained filters or a linear combination of these filters, before computing the gain constrained channel filters.

For instance, in the case of stereo, the equivalent side signal filter is (as used in FIG. 8):

$$\underline{h}_s^{sc}=0.5\underline{h}_{c1}^{sc}-0.5\,\underline{h}_{c2}^{sc}$$

and in order to reduce possible artifacts, the gain difference of this filter between successive frames is smoothened leading to a filter $\underline{otlh}_s^{sc}$. The channel filters are then modified according to:

$$\underline{otlh}_{c1}^{sc}=\delta+\underline{otlh}_s^{sc}$$

$$\underline{otlh}_{c2}^{sc}=\delta-\underline{otlh}_s^{sc}.$$

This type of modification does not conserve the shape constraints, however, one can easily see that the shape constraints are still conserved on the side signal filter and this is enough in the case of stereo coding.

The gain constraint on the filters assumes previously computed channel energies, i.e. $E_{c1}$, $E_{c2}$. It is important to control the gains of the filters, e.g. $g_{c1}$, $g_{c2}$ and to avoid unnecessary amplification by limiting the gains. Depending on the properties of the different channel signals, it may occur that the channels are anti-correlated on the whole frequency range or in certain frequency bands. This leads to a certain cancellation when the mono channel is formed. In this case, since the individual channel information has been lost, at least partially and in some frequency bands, it is often beneficial to limit the channels gains when these are greater than a certain amount, e.g. 0 dB. One way to perform this gain limitation is to compute a certain gain factor:

$$g_F=\frac{4\sum_{n=0}^{N-1}x(n)^2}{\sum_{n=0}^{N-1}c1(n)^2+\sum_{n=0}^{N-1}c2(n)^2}$$

which is the ratio of the effective mono channel energy and the energy of the mono channel if the two channels were uncorrelated. When this factor is less than 0 dB, then we have signal cancellation. In this case, $g_F$ quantifies how severe this cancellation is. The gain limitation can then be computed as:

$$g_{c1}(\mathrm{dB})=\max(g_{c1}(\mathrm{dB})+g_F(\mathrm{dB}),0),\ \text{when } g_F<0\ \mathrm{dB}.$$

The same limitation holds for the gain of the other channels.

Not only the channel filter parameters need to be encoded and transmitted, but also the mono signal. There are two different principle approaches to consider the mono signal audio coding when deriving the channel filter coefficients.

In an open-loop fashion, the filters are derived based on the original mono signal. This is e.g. the case in FIG. 2*a*, where the signal 42 is the original mono signal x. The decoder, however, will use a quantized mono signal as input for the channel filtering.

In a closed-loop fashion, the filter calculations are based on the coded and thus already quantized mono signal. This is e.g. the case in FIG. 3*a*, where the signal 44 is a decoded mono signal x". This approach has the advantage that the channel filter design does not only aim to match the respective channel signals in a best possible way. It also aims to mitigate coding errors, which are the result of the mono signal encoding.

The principles described hitherto are applicable on the complete spectrum, i.e. full-band signals. However, they are equally well or even more beneficially applicable on sub-bands of the signals. FIG. 9 illustrates the principles of sub-band processing. A number of channels $c_1$-$c_N$ are each divided in K sub-bands SB1, SB2, SBK. The channel signals in each sub-band is provided to a respective multi-channel encoder unit 80:1-80:K, where the channel signals are encoded. One or several of the multi-channel encoder units 80:1-80:K can be multi-channel encoder units according to the present invention. A bit-stream combiner 82 combines the encoded signals into a common encoded signal 53, that is transmitted.

Advantages of the described sub-band processing are that the multi-channel encoding for the different sub-bands can be carried out individually optimized with respect to e.g. assigned bit rate, processing frame sizes and sampling rate.

One special kind of sub-band processing does not carry out multi-channel encoding for very low frequencies, e.g. below 200 Hz. That means that for this very low frequency band, a mere mono signal is transmitted. This principle makes use of the fact that the human stereo perception is less sensitive for very low frequencies. It is known from prior art and called sub-woofing.

In a further embodiment of the sub-band processing the band splitting is done using a time-frequency transform such as, e.g. a short term Fourier transform (STFT), which allows decomposing the signal into single frequency components. In this case, the filtering reduces to a mere multiplication of the individual spectral coefficients of the mono signal with a complex factor.

The parametric multi-channel coding method according to the invention will typically involve fixed frame-wise processing of signal samples. In other words, parameters describing the multi-channel image are derived and transmitted with a rate corresponding to a coding frame length of, e.g. 20 ms. The parameters may, however, be obtained from signal frames which are much larger than the coding frame length. A suitable choice is to set the length of such analysis frames to values larger than the coding frame length. This implies that the parameter calculation is performed with overlapping analysis frames.

Figure 10:
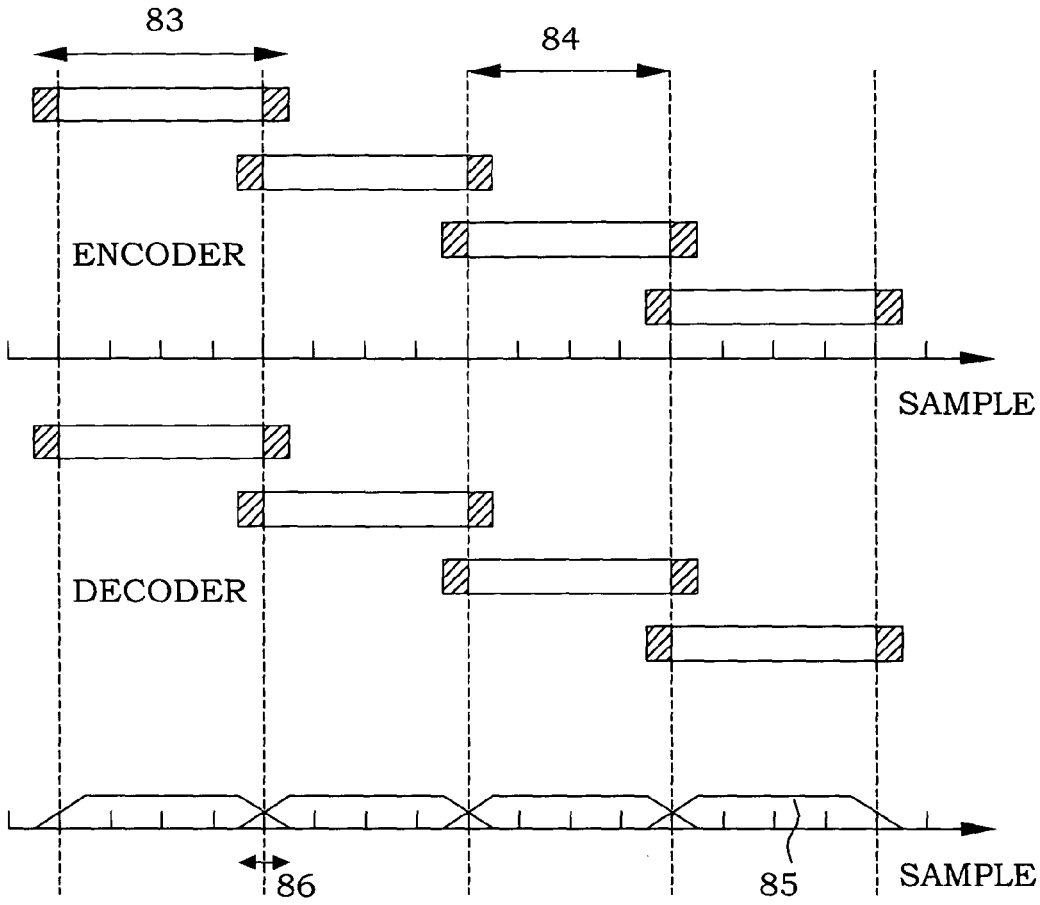
FIG. 10 is a composite diagram illustrating overlapping analysis for encoding and decoding.

This is illustrated in FIG. 10. Analysis frames 83 at the encoder are slightly longer than encoding frames 84, as shown in the top of the figure. A consequence of such overlapping analysis frames is that the parameters evolve smoothly, which is essential in order to provide a stable multi-channel audio signal impression. The same is performed at the decoder side, shown in the middle of the figure. It is thus essential in the decoder to take account of this and to window and overlap-add synthesis frames 85, with an overlap 86, as shown at the bottom of the figure. This allows a smooth transition between filters associated with each frame.

Also at the encoder, smooth filter parameter evolution can be enforced. It is, e.g. possible to apply low-pass or median filtering to the filter parameters.

State-of-the-art monophonic audio codecs as well as speech codecs perform so-called noise shaping of the coding noise. The purpose of this operation is to move coding noise to frequencies where the signal has high spectral density and thus render the noise less audible. Noise shaping is usually done adaptively, i.e. in response to the audio signal. This implies that, in general, the noise shaping performed on the mono signal will be different from what is required for the various channel signals. As a result, despite proper noise shaping in the mono audio codec, the subsequent channel filtering according to the invention may lead to an audible coding noise increase in the reconstructed multi-channel signal when comparing to the audible coding noise in the mono signal.

In order to mitigate this problem, signal-adaptive post-filtering may be applied to the reconstructed channel signals in a post-processing step of the receiver. Any state-of-the-art post-filtering techniques can be deployed here, which essentially emphasize spectral tops or deepen spectral valleys and thereby reduce the audible noise. One example of such a technique is so-called high-resolution post-filtering which is described in the European Patent 0 965 123 B1 by E. Ekudden et. al. Other simple methods are so-called pitch- and formant post-filters, which are known from speech coding.

Figure 11:
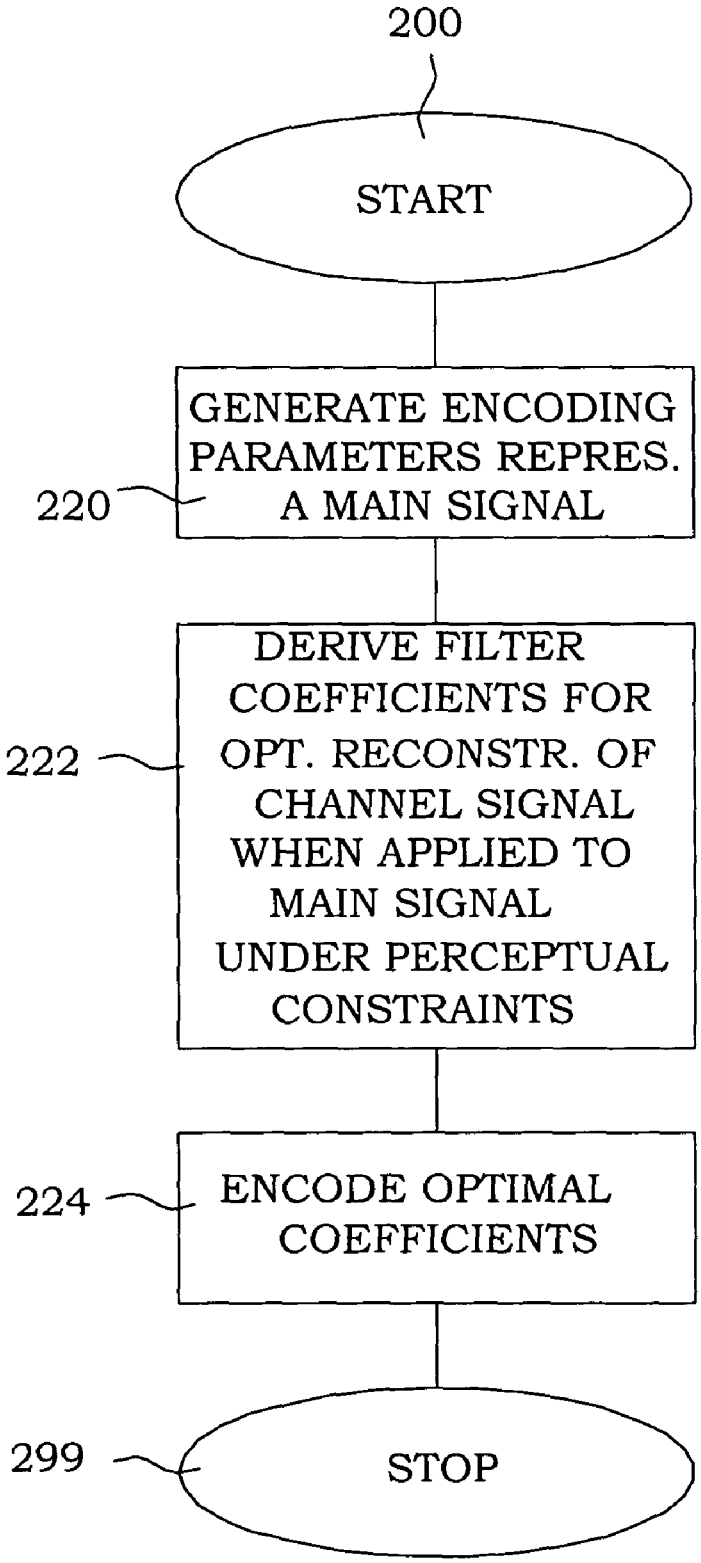
FIG. 11 is a flow diagram of the basic steps of an embodiment of an encoding method according to the present invention.

In FIG. 11, the main steps of an embodiment of an encoding method according to the present invention are illustrated as a flow diagram. The procedure starts in step 200. In step 220, a main signal, preferably a mono signal, deduced from the multi-channel signals is encoded. In step 222, filter coefficients are optimized to give an as good representation as possible of a channel signal when applied to the main signal. The optimizing takes place under perceptual constraints. The optimal coefficients are then encoded in step 224. The procedure ends in step 299.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined into other configurations, where technically possible. The scope of the present invention is, however, defined by the appended claims.

REFERENCES

U.S. Pat. No. 5,285,498
U.S. Pat. No. 5,434,948
European patent 0 497 413
European Patent 0 965 123
International patent application WO 03/090206
"Binaural cue coding applied to stereo and multi-channel audio compression", 112th AES convention, May 2002, Munich, Germany by C. Faller et al.

The invention claimed is:

1. A method of coding multi-channel signals having at least a first channel signal and a second channel signal, comprising the steps of:

generating encoding parameters representing a main signal being a first predetermined linear combination of at least said first and second channel signals;

deriving optimal parameters of a first adaptive filter;

deriving optimal parameters of at least a second adaptive filter; and encoding the optimal parameters of the first and second adaptive filters;

said first adaptive filter being derived to give a first minimum difference between the first channel signal and a first adaptive filter output signal when the first adaptive filter is applied on the first predetermined linear combination;

the first minimum difference being defined according to a first criterion;

said second adaptive filter being derived to give a second minimum difference between the signal of the second channel and a second adaptive filter output signal when the second adaptive filter is applied on the first predetermined linear combination;

the second minimum difference being defined according to a second criterion; and wherein the deriving steps of said first and said second adaptive filters are performed under at least one perceptual constraint selected from the group of gain constraint and shape constraint.

2. A method according to claim 1, wherein at least one of the first criterion and the second criterion is a least mean square criterion.

3. A method according to claim 1, wherein the perceptual constraint is at least a gain constraint, striving to give a total energy of the respective one of said first and second adaptive filter output signal equal to a total energy of the corresponding one of said first and second channel signals.

4. A method according to claim 3, wherein the gain constraint is an absolute constraint, demanding that the total energy of the respective one of said first and second adaptive filter output signal is equal to the total energy of the corresponding one of said first and second channel signals.

5. A method according to claim 3, wherein the gain constraint is a soft constraint, favoring adaptive filters giving the total energy of the respective one of said first and second adaptive filter output signal close to the total energy of the corresponding one of said first and second channel signals.

6. A method according to claim 3, wherein the gain constraint is imposed as a gain factor times an adaptive filter derived without gain constraints.

7. A method according to claim 6, wherein the first and second adaptive filters, respectively, comprise a gain constrained filter $\underline{h}_c^{gc}$ given by:

$$\underline{h}_c^{ge} = g_c \underline{h}_c^{uc},$$

$$g_c = \sqrt{\frac{E_c}{\sum_{n=frame_start}^{frame_end} \hat{c}^{uc}(n)^2}}.$$

where $\underline{h}_c^{uc}$ is the respective adaptive filter derived without gain constraints, $E_c$ is a prescribed energy strived for by the respective one of said first and second adaptive filter output signal and $\hat{c}^{uc}(n)$ is a respective adaptive filter output signal of the main signal x(n) without gain constraints.

8. A method according to claim 1, wherein the perceptual constraint is at least a shape constraint, imposing a predefined spectral shape on the respective one of said first and second adaptive filter output signals.

9. A method according to claim 8, wherein the shape constraint imposes null content in a predefined frequency range.

10. A method according to claim 1, wherein the step of encoding the optimal parameters comprises jointly coding of the optimal parameters of the first and second adaptive filters.

11. A method according to claim 1, wherein the steps of deriving optimal parameters of said first adaptive filter and deriving optimal parameters of said second adaptive filter are performed based on the encoding parameters representing the main signal.

12. A method according to claim 1, wherein the steps of deriving optimal parameters of said first adaptive filter and deriving optimal parameters of said second adaptive filter are performed based directly on the first predetermined linear combination.

13. A method according to claim 1, wherein the multi-channel signals comprise more than two channel signals, wherein the first predetermined linear combination is based on all the more than two channel signals, and each channel signal is represented by a respective adaptive filter, optimized under the perceptual constraint.

14. A method of decoding multi-channel signals having encoding parameters into multi-channel signals, said encoding parameters representing a main signal, encoded optimal parameters of a first adaptive filter, and encoded optimal parameters of a second adaptive filter, said method comprising the steps of:

decoding the encoding parameters representing the main signal into a decoded main signal; and generating a first channel signal of said multi-channel signals by applying the first adaptive filter to the decoded main signal;

generating a second channel signal of said multi-channel signals by applying the second adaptive filter to the decoded main signal;

the first and second adaptive filters being optimized under at least one perceptual constraint selected from the group of gain constraint and shape constraint.

15. A method according to claim 14, further comprising the step of generating the second channel signal as a predetermined linear combination of the decoded main signal and the first channel signal.

16. Encoder apparatus for encoding of multi-channel signals, comprising:

input for said multi-channel signals, said multi-channel signals comprise at least a first channel signal and a second channel signal;

means for generating encoding parameters representing a main signal;

said main signal being a first predetermined linear combination of at least said first and second channel signals;

said means for generating being connected to the input;

means for deriving optimal parameters of a first adaptive filter;

means for deriving optimal parameters of at least a second adaptive filter;

means for encoding the optimal parameters of the first and second adaptive filters;

the first adaptive filter giving a first minimum difference between the first channel signal and a first adaptive filter output signal when the first adaptive filter is applied on the first predetermined linear combination;

the first minimum difference being defined according to a first criterion;

the second adaptive filter giving a second minimum difference between the second channel signal and a second adaptive filter output signal when said second adaptive filter is applied on the first predetermined linear combination;

the second minimum difference being defined according to a second criterion; and output means;

wherein the means for deriving optimal parameters of said first and said second adaptive filters are arranged for deriving the optimal parameters under at least one perceptual constraint selected from the group of gain constraint and shape constraint.

17. Decoder apparatus for decoding multi-channel signals, comprising:

input for encoding parameters, said encoding parameters representing a main signal, encoded optimal parameters of a first adaptive filter, and encoded optimal parameters of a second adaptive filter;

means for decoding the encoding parameters representing the main signal into a decoded main signal;

means for generating a first channel signal of said multi-channel signals by applying the first adaptive filter to the decoded main signal; and means for generating a second channel signal of said multi-channel signals by applying the second adaptive filter to the decoded main signal;

the first and second adaptive filters being optimized under at least one perceptual constraint selected from the group of gain constraint and shape constraint.

18. Encoder apparatus for encoding of multi-channel signals, comprising:

input for said multi-channel signals, said multi-channel signals comprise at least a first channel signal and a second channel signal;

data processing circuitry arranged to generate encoding parameters representing a main signal;

said main signal being a first predetermined linear combination of at least said first and second channel signals;

said data processing circuitry being further arranged to derive optimal parameters of a first adaptive filter and of at least a second adaptive filter;

said data processing circuitry being further arranged to encode the optimal parameters of the first and second adaptive filters; and an output;

the first adaptive filter giving a first minimum difference between the first channel signal and a first adaptive filter output signal when said first adaptive filter is applied on the first predetermined linear combination;

the first minimum difference being defined according to a first criterion;

the second adaptive filter giving a second minimum difference between the second channel signal and a second adaptive filter output signal when said second adaptive filter is applied on the first predetermined linear combination;

the second minimum difference being defined according to a second criterion;

wherein the data processing circuitry is further arranged to derive the optimal parameters under at least one perceptual constraint selected from the group of gain constraint and shape constraint.

19. Decoder apparatus for decoding multi-channel signals, comprising:

input for encoding parameters, said encoding parameters representing a main signal, encoded optimal parameters of a first adaptive filter, and encoded optimal parameters of a second adaptive filter;

a decoder for decoding the encoding parameters representing the main signal into a decoded main signal;

a first signal generator for generating a first channel signal of said multi-channel signals by applying the first adaptive filter to the decoded main signal; and a second signal generator for generating a second channel signal of said multi-channel signals by applying the second adaptive filter to the decoded main signal;

the first and second adaptive filters being optimized under at least one perceptual constraint selected from the group of gain constraint and shape constraint.

* * * * *

UNITED STATES PATENT AND TRADEMARK OFFICE

CERTIFICATE OF CORRECTION

PATENT NO. : 7,725,324 B2
APPLICATION NO. : 11/011764
DATED : May 25, 2010
INVENTOR(S) : Bruhn et al.

It is certified that error appears in the above-identified patent and that said Letters Patent is hereby corrected as shown below:

In Column 4, Line 4, after "in a" delete "is".

In Column 7, Line 7, delete "$r^{ue}(n)^2$." and insert -- $r^{uc}(n)^2$. --, therefor.

In Column 7, Line 29, delete "$r_{xx}$=" and insert -- $r_{xc}$= --, therefor.

In Column 8, Line 31, delete "$c1(n) = \sum_{k \in l} h_{cl}(k) \cdot x(n-k),$" and insert -- $\hat{c}1(n) = \sum_{k \in l} h_{c1}(k) \cdot x(n-k),$ --, therefor.

In Column 8, Lines 64-65, delete "$\lambda\left(E_{cl} - \sum_{n=frame\ start}^{frame\ end} \hat{c}1(n)^2\right)$" and insert -- $\lambda\left(E_{c1} - \sum_{n=frame\ start}^{frame\ end} \hat{c}1(n)^2\right)$ --, therefor.

In Column 9, Lines 6-9, delete "$g_n = \sqrt{\frac{E_{cl}}{\sum_{n=frame\ start}^{frame\ end} \hat{c}1^{ge}(n)^2}}$." and Signed and Sealed this
Twentieth Day of March, 2012

David J. Kappos

David J. Kappos
*Director of the United States Patent and Trademark Office* insert -- $g_a = \sqrt{\dfrac{E_{c1}}{\sum_{n=frame\ start}^{frame\ end} \hat{c}1^{uc}(n)^2}}$ --, therefor.

In Column 9, Line 30, delete " $\sum_{k \in l} h_c(k)$ " and insert -- $\sum_{k \in l} h_c(k)$ --, therefor.

In Column 9, Line 44, delete " $\underline{h}_c^{uc} =$ " and insert -- $\underline{h}_c^{sc} =$ --, therefor.

In Column 9, Line 56, delete "$h_e^{gec} = g_c h_c^{sc}$, $g_e =$" and insert -- $h_c^{gsc} = g_c h_c^{sc}$, $g_c =$ --, therefor.

In Column 10, Line 6, delete " $\overset{W}{\approx}1$ " and insert -- $\overset{W}{=}c1$ --, therefor.

In Column 10, Line 39, delete " $\underline{h}^{uc}$ " and insert -- $\underline{h}_s^{uc}$ --, therefor.

In Column 11, Line 13, delete " $\underline{otlh}_s^{sc}$ " and insert -- $\underline{\tilde{h}}_s^{sc}$ --, therefor.

$$\underline{otlh}_{c1}^{sc} = \delta + \underline{otlh}_s^{sc} \qquad \underline{\tilde{h}}_{c1}^{sc} = \delta + \underline{\tilde{h}}_s^{sc}$$

In Column 11, Lines 16-18, delete " $\underline{otlh}_{c2}^{sc} = \delta - \underline{otlh}_s^{sc}$ ." and insert -- $\underline{\tilde{h}}_{c2}^{sc} = \delta - \underline{\tilde{h}}_s^{sc}$. --, therefor.

In Column 11, Line 40, delete " $g_F =$ " and insert -- $g_F =$ --, therefor.

In Column 14, Line 36, in Claim 7, delete " $\underline{h}_c^{ge}$ " and insert -- $\underline{h}_c^{gc}$ --, therefor.

In Column 14, Lines 39-41, in Claim 7, delete " $g_c = \sqrt{\dfrac{E_c}{\sum_{n=frame\ start}^{frame\ end} \hat{c}^{uc}(n)^2}}$ ." and insert -- $$g_c = \sqrt{\frac{E_c}{\sum_{n=frame\ start}^{frame\ end} \hat{c}^{sc}(n)^2}}$$ , --, therefor.